US005286355A

United States Patent [19]

Fainchtein et al.

[11] Patent Number: 5,286,355

[45] Date of Patent: Feb. 15, 1994

[54] ELECTROCHEMICAL WIRE SHARPENING DEVICE AND METHOD FOR THE FABRICATION OF TIPS

[75] Inventors: Raul Fainchtein, Rockville; Paul R. Zarriello, Catonsville, both of Md.

[73] Assignee: The Johns Hopkins University, Baltimore, Md.

[21] Appl. No.: 743,649

[22] Filed: Aug. 12, 1991

[51] Int. Cl.[5] ..... C25F 3/14; C25F 7/00

[52] U.S. Cl. ..... 204/129.55; 204/129.75; 204/129.95; 204/224 M; 204/225; 204/228

[58] Field of Search ..... 204/129.55, 129.75, 204/129.95, 224 M, 225, 228

[56] References Cited

U.S. PATENT DOCUMENTS

| | | | |
|---|---|---|---|
| 2,434,286 | 1/1948 | Pfann | 204/129.55 |
| 2,628,936 | 2/1953 | Albano | 204/129.55 |
| 2,850,448 | 9/1958 | Stricker | 204/129.55 X |
| 3,276,986 | 10/1966 | Swistun | 204/225 X |
| 3,524,803 | 8/1970 | Rannefeld | 204/129.2 |
| 3,556,953 | 1/1971 | Schultz | 204/129.55 X |
| 3,697,403 | 10/1972 | Colwell | 204/218 |
| 4,375,396 | 3/1983 | Green et al. | 204/129.55 |
| 4,430,180 | 2/1984 | Shimizu | 204/225 X |
| 4,935,865 | 6/1990 | Rowe et al. | 204/129.2 X |
| 5,035,780 | 7/1991 | Suzuki et al. | 204/129.55 |
| 5,085,746 | 2/1992 | Musselman et al. | 204/129.55 |

OTHER PUBLICATIONS

The art and science and other aspects of making sharp tips, J. Vac. Sci. Technol. 89 (2) Mar./Apr. 1991, pp. 601-608.

Platinum/Iridium tips with controlled geometry for scanning tunneling microscopy, J. Vac. Sci. Technol. A8(4), Jul./Aug. 1990, pp. 3558-3562.

Preparation of STM tips for in-situ characterization of electrode surfaces, Journal of Microscopy, vol. 152, Pt-3, Dec. 1988, pp. 651-661.

*Primary Examiner*—Donald R. Valentine

*Attorney, Agent, or Firm*—Mary Louise Beall

[57] ABSTRACT

The invention is a process for making sharp tips. A computer controlled instrument and process characterizes the tip while in formation and reliably produces tips having a radius of curvature of approximately 100 nm. In the invention, the position of the wire during the etching operation is mechanically controlled while the etching current is monitored. When the current reaches a predetermined level, the process is halted.

29 Claims, 4 Drawing Sheets

ELECTROCHEMICAL WIRE SHARPENING DEVICE AND METHOD FOR THE FABRICATION OF TIPS

STATEMENT OF GOVERNMENTAL INTEREST

The Government of the United States has rights in this invention pursuant to Contract No. N00039-89-C-0001 awarded by the Department of the Navy.

BACKGROUND OF THE INVENTION

The invention relates to a method and apparatus to produce sharp tips. Many techniques and recipes have been reported on the production of sharp tips. In particular, a recent article entitled "The art and science and other aspects of making sharp tips," *J. Vac. Sci. and Technol.*, B 9 (2), Mar/Arp 1991 pp. 601–608, by Allan J. Melmed, summarizes most of them. Most of these techniques for tip production rely on empirical information collected through the years. The problem with all reported techniques is that they lack reliability. Unless each resulting tip is imaged by an electron microscope, there is no way to know whether the tip is sharp enough for an intended use. This is particularly crucial when the tip is to be used in a controlled environment such as vacuum or low temperature.

U.S. Pat. No. 4,375,396 teaches a basic electrochemical method for forming sharp tips on thin wires. It teaches monitoring the current and cutting the current when it reaches a certain level. It does not disclose moving the wire in and out of the electrolyte.

U.S. Pat. No. 4,935,865 teaches using a computer to control an electropolishing system but does not teach tip preparation.

U.S. Pat. No. 3,697,403 teaches monitoring and storing a control parameter such as voltage for use in a control system of an electrochemical grinding apparatus (see Summary of the Invention). The grinding apparatus employs a rotating type tool and does not relate to tip preparation.

U.S. Pat. No. 2,434,286 teaches an electromechanical method of forming a point at the end of a wire. However this method does not teach monitoring the current.

The Melmed paper discussed above discloses an electrochemical etching process including moving the tip out of the electrolyte while observing the etching process with a microscope. However, moving the tip in response to current monitoring is not taught.

Other references of general background interest are: "Platinum/Iridium tips with controlled geometry for scanning tunneling microscopy," by Inga Holl Musselman et al, *J. Vac. Sci. Technol.*, A 8 (4), Jul/Aug 1990, pp. 3558, and "Preparation of STM tips for in-situ characterization of electrode surfaces," by Michael J. Heben et al, *J. Microscopy*, 152, 3, Dec 1988, pp. 651–661.

OBJECTS OF THE INVENTION

A primary object of the this invention is a reliable apparatus and process for the production of high quality sharp tips.

Another object of the invention is a process for the production of sharp tips wherein data obtained during the process itself indicates whether or not the produced tip is of sufficient high quality.

It is also an object of the invention to reliably produce sharp tips in a rapid, reproducible manner.

SUMMARY OF THE INVENTION

The invention relates to an computer controlled instrument and procedure able to characterize a tip while in formation and reliably produce tips having a radius of curvature of approximately 100 nm. It has particular application for the preparation of tips (sharp points, probes, etc.) for use in field ion microscopy (FIM), scanning tunneling microscopy (STM) and other related microscopies. These tips are increasingly being used for biomedical applications and as electron sources in various types of electron microscopies.

The sharpness of a tip is related to the radius of curvature of the cone shape of the tip: the smaller the radius of curvature, the sharper the tip. The sharpness of the tip is also related to the length and diameter of the cone. Moreover, the inventors believe that moving the tip out of the solution during the etching process helps break away the meniscus between the tip and the solution at the end of the etching process which produces a better tip. Thus, in the invention, the mechanical control of the position of the wire during the etching operation is combined with monitoring the magnitude of the etching current. In a reliable, reproducible manner, tips produced according to the present invention have a radius of curvature in the range of 50–150 nm.

According to the invention, a wire is electrochemically etched to form a sharp tip while the root mean square (rms) etching current is monitored. The value of current observed monitors the state of the etching process while the wire is in the electrolyte and is an indicator of how much material has been etched from the wire.

The electrochemical etching process requires that the wire to be etched reacts with an electrolyte while a current is passed through. The end of the wire is dipped into an electrolyte and serves as an electrode. A second electrode is also present. When a voltage is applied to the wire, a current is generated in the electrolyte between the two electrodes. This is called the etching current and it is this current which is monitored. The rms values of this current are stored in a computer file, compared to preset values or parameters and also are displayed on a computer screen. When the value of the rms current reaches a preset parameter or cutoff point, the etching process is stopped.

As the etching process progresses, the wire is pulled step by step out of the electrolyte solution by a stepper motor at a rate of one step every 1 to 700 msec.

The determination of the cutoff point has been made experimentally. The inventors, seeking a reliable, reproducible method to make high quality tips, studied several parameters of the electrochemical etching operation. In particular, different tips were mechanically withdrawn from the solution at different rates while the etching current was monitored. Each tip produced was examined by scanning electron microscopy (SEM) to determine which tips were best and the factors which lead to the production of the best tips. It was determined that the best tips had been formed when the current recorded during the forming process produced a graphic curve very similar to that shown in FIG. 4. The best tips were also produced when the process was halted at the point indicated by the arrow in FIG. 4. This information/data is stored in the computer storage files. In operation, the current monitored is compared to the stored data.

DESCRIPTION OF THE PREFERRED EMBODIMENTS

Figure 1:
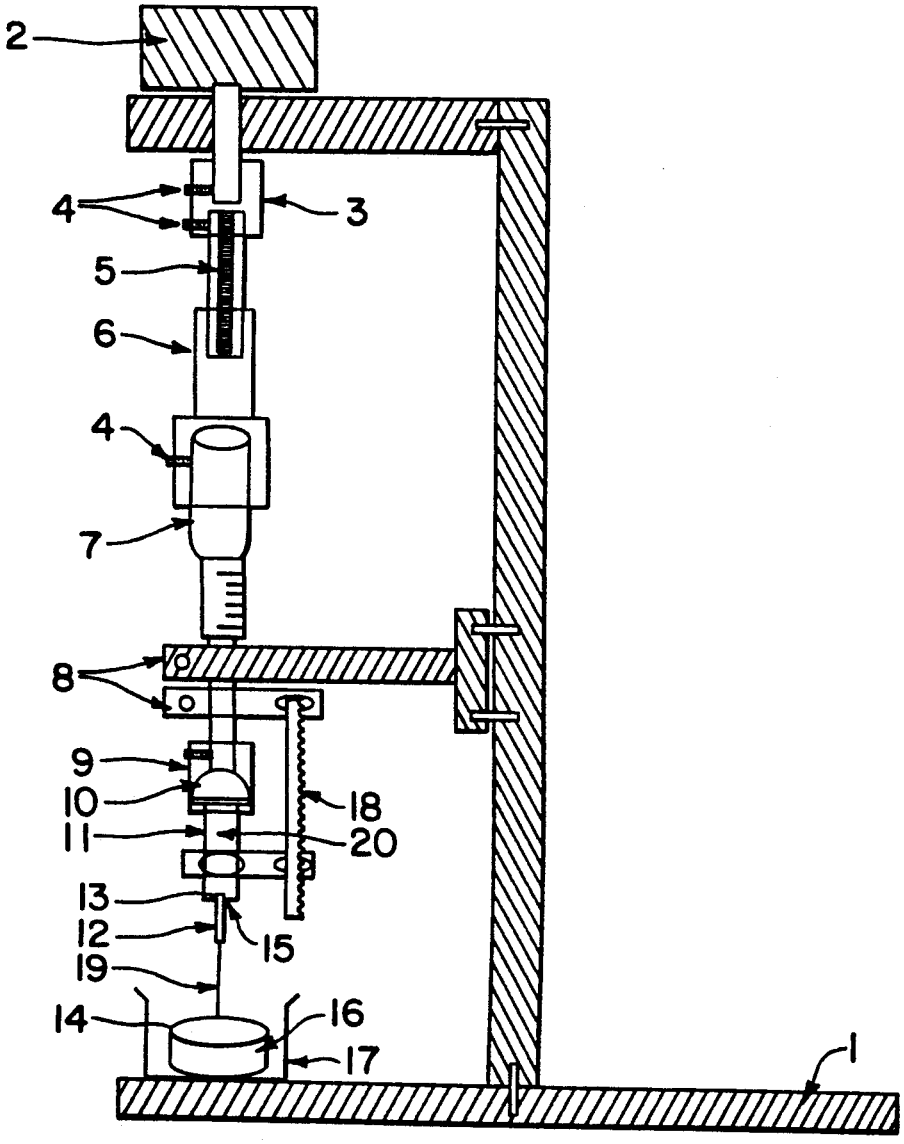
FIG. 1 is a drawing of the apparatus of the invention.

An example of the apparatus used to fabricate tips out of wire is described referring to FIG. 1, where 1 is the aluminum frame supporting the apparatus. The wire to be formed into a tip 19 is held at the end of a vertically oriented micrometer 7 rotated by the action of a phase stepper motor located at the top of micrometer 7. The wire/tip is held by friction in a tip holder 12 attached to the micrometer shaft by an electrically insulating nylon (9) and ceramic (11) holder. Spring 10, located within the holder assists in converting the rotation motion of stepper motor 2 to vertical motion to be applied to wire/tip 19. Stepper motor 2 is connected to micrometer 7 by means of rubber coupling 3, set screws 4, spline shaft 5 and brass coupling 6. The micrometer is attached to frame 1 by one of clamps 8. The other clamp 8 secures brass guide rod 18 which stabilizes the vertical motion of the wire/tip 19.

The wire/tip 19 is constrained to a vertical motion in and out of a chemical solution or electrolyte in beaker 17. Also present in beaker 17 is an electrode 16, for example a graphite ring. Electrical connections 13 and 14 respectively connect wire/tip 19 and electrode 16 to the computer control system of FIG. 2. Stepper motor 2 is also electrically connected to this computer control system.

Figure 2:
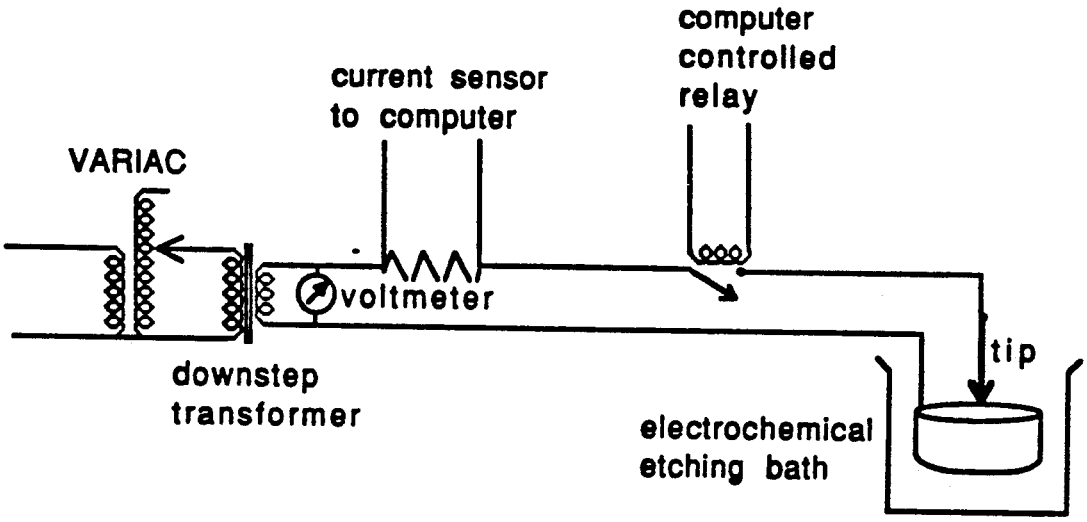
FIG. 2 is an electric schematic drawing of the computer control system of the invention.

As shown in FIG. 2, wire/tip 19 to be sharpened is electrically connected to one lead of a downstep or stepdown transformer driven by a variable autotransformer connected to a power supply (not shown). The connection from tip 19 to the downstep transformer is made through a computer controlled relay and a current sensor or monitor. This particular current sensor is a shunt resistor and operates as the etching current monitor of the invention. The return lead of the downstep transformer is connected to graphite ring 16 located in beaker 17 as is tip 19 (see FIG. 1). Note that the downstep transformer is used to provide isolation from the primary power line and to prevent group loops made with the analog to digital converter of the computer.

Stepper motor 2, the relay and the current monitor are controlled by a computer (not shown). The software for data acquisition and control operates according to the software control flow chart of FIG. 3.

Figure 3:
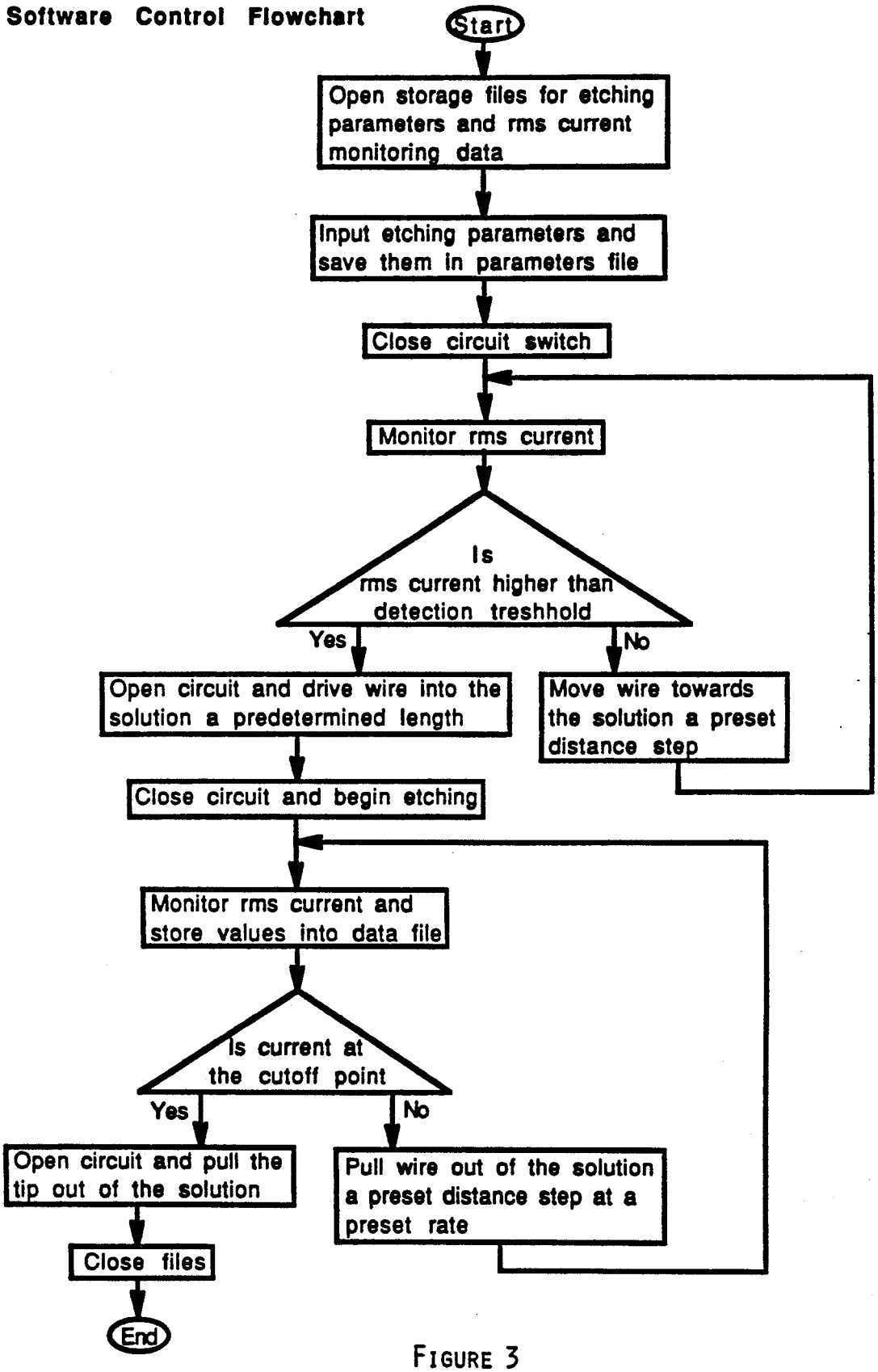
FIG. 3 is a software control flow chart of the process of the invention.

The following is an example of the apparatus of FIG. 1 performing the process according to the software control of FIG. 3.

A tungsten (W) wire 19 approximately 2 cm long and 0.010 inches in diameter is positioned in tip holder 12 connected to micrometer 7. A beaker 17 containing a graphite ring counterelectrode 16 in a 1 molar solution of KOH is positioned underneath the wire at a distance of about 2 mm from the liquid-air interface of the surface of the solution. The variable auto transformer is set so as to provide a voltage of approximately 25 V rms voltage in the secondary coil of the downstep transformer. After setting the parameters for the appropriate etching conditions, the program is activated.

The analog to digital converter of the computer is set to take 200 samples of the etching current with a 330 μsec sampling period. This provides approximately ten 60 Hz cycles upon which to compute the rms current.

Figure 4:
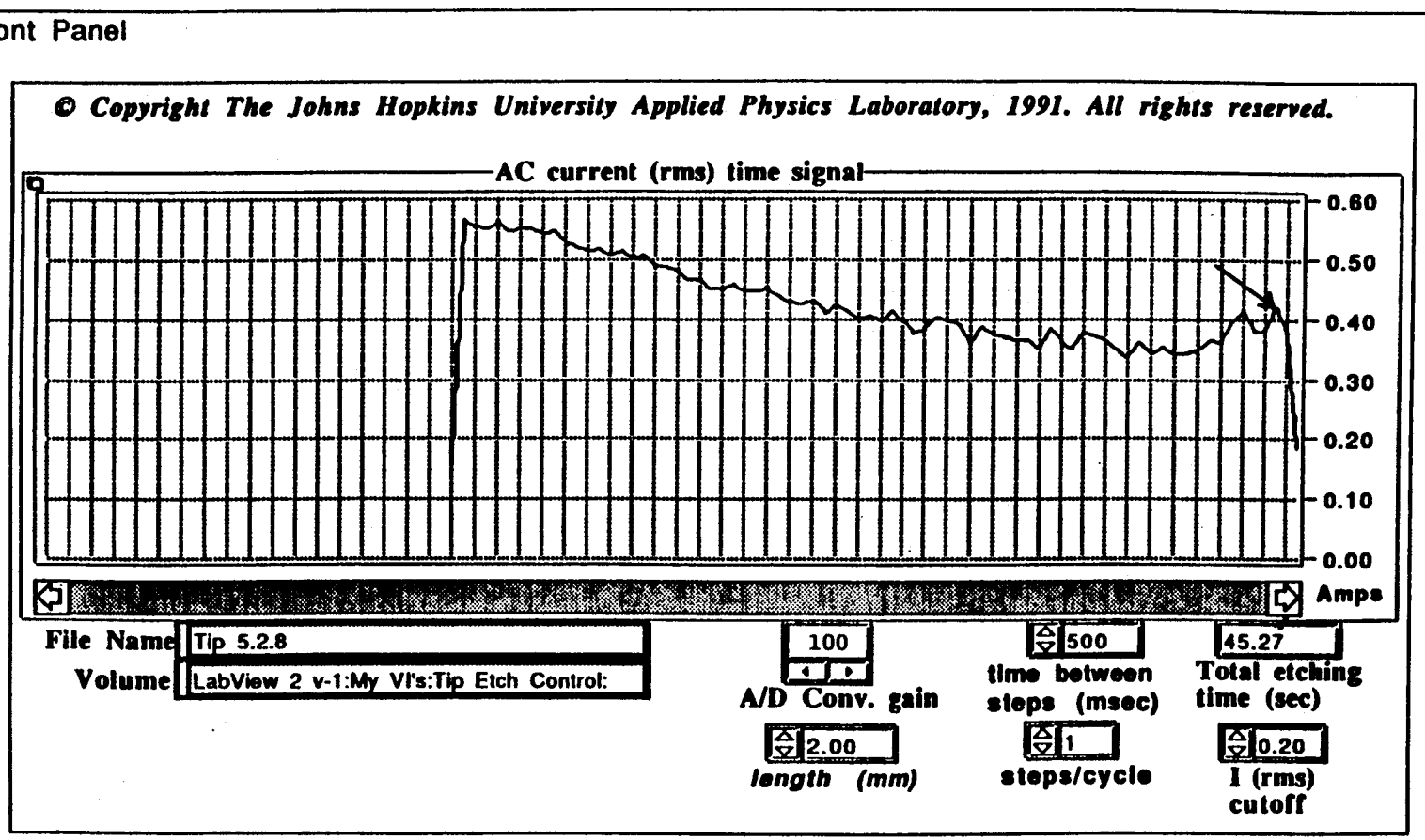
FIG. 4 is a computer screen display panel showing the values of the rms current with time.

The parameters to be set are shown in the display panel of FIG. 4, wherein "A/D Conv. gain" is the analogue to digital converter gain. For this example, it is set at "100" but may be changed to adjust for other metals or other wire lengths. The "time between steps (msec)" is the time between steps of the stepper motor, expressed in milliseconds. Here it is set at 500. The "length (mm)" refers to the length of the portion of wire 19 inserted into the solution and is expressed in millimeters, in this case 2.00. The "steps/cycle" is the number of steps of the stepper motor per cycle. Here, the stepper motor will move wire 19 down one step or 1.28 μm per cycle. "I (rms) cutoff" is the root mean square ac current value selected to trigger the cutoff of the etching process. In this case a value of 0.20 amps has been selected.

Note that "Total etching time (sec)" is not a parameter but is a record of the actual time required to etch wire 19, expressed in seconds. In this example, this value is 45.27 seconds. Total etching times vary according to the length of the wire dipped into the solution and the KOH concentration of the electrolyte which changes in time.

As shown in the flowchart of FIG. 4, the program is activated by closing the circuit switch. The current monitor begins operation and will sense no current until the wire is in contact with the solution in the beaker. When the threshold current is detected, the wire is driven into the solution a distance of 2 mm. The rms current is monitored in accordance with the preset parameters and, when the cutoff current is reached, the operation is stopped.

The etching current monitoring produces current vs. time data which is shown graphically on the panel display of FIG. 4. This data is stored in the computer storage files and compared to similar data produced in the fabrication of quality tips. This comparison indicates that the current/time curve of FIG. 4 closely follows the curves produced by the stored data.

An SEM examination of the thus produced tungsten tip shows that it has a radius of curvature of approximately 100 nm. This result has been reliably reproduced.

Also in the example above, the micrometer has a 0.020 inches per revolution pitch and is rotated by the action of a 400 step per revolution VEXTA PX243M-03AA 2 phase stepper motor. Each step of the motor corresponds to a vertical translation of 1.28 μm. The stepdown transformer is a 33% transformer (i.e., ratio of primary to secondary turns is 3 to 1) and is driven by a VARIAC autotransformer. The current monitor is a 0.1 Ohm shunt resistor.

DISCUSSION

Repeated experiments have shown that, when the current vs. time graph produced by the current monitored during tip fabrication does not correspond closely to the curve produced for that particular type material such as that shown in FIG. 4, the tip is inferior. Thus, comparing the tip specific curve with known curves associated with superior tips is a method of determining the quality of the tips as it is being made. No examination by SEM is required.

To prepare Pt-Ir tips, a 20% solution of KCN in $H_2O$ is used as the electrolyte solution in the beaker.

Although the ac current is used in the example above, the process may also be operated using dc current with appropriate circuitry.

The voltage provided by the variable auto transformer is in the range of 10–40 V rms.

The wire to be etched may be of any length. However 1–4 cm produces good tips. The inventors have successfully operated the process with wire having a diameter in the range of 0.005–0.050 inches. However, thicker wires may be used. The dipping length is 1–3 mm.

The digitizer in the example above is set for 200 samples with a 330 μsec sampling period. However an acceptable range is between 8 samples with a 2 msec sampling period and 400 samples with a 165 μsec sampling period.

Each step of the stepper motor is in about 1.28 μm in vertical translation.

The invention described is not intended to be limited to the embodiments disclosed but includes modifications made within the true spirit and scope of the invention.

We claim:

1. An electrochemical etching process for preparing a tip comprising:

providing a wire to be sharpened to a tip;

placing the wire in a container containing an electrolyte solution and an electrode;

moving the wire into the electrolyte;

applying a voltage to the wire, etching the wire and monitoring the resulting etching current in the electrolyte;

stopping the etching process when a preselected current is reached; and including withdrawing the wire from the electrolyte step by step during the etching and at a time interval in the range of 1–700 msec.

2. A process according to claim 1, wherein the preselected current is determined experimentally.

3. A process according to claim 1, including:

recording the etching current vs. etching time data, storing the data, and comparing it to similar previously stored data for the electrochemical etching process for preparing tips having a radius of curvature in the range of 50–150 nm, wherein when the recorded data closely corresponds to the previously stored data, the thus prepared tip has a radius of curvature in the range of 50–150 nm.

4. A process according to claim 1, wherein monitoring includes providing for taking etching current samples in a range of 8 samples with a 2 msec sampling period and 400 samples with a 165 μsec sampling period.

5. A process according to claim 4, wherein 200 samples with a 330 μsec are provided for.

6. A process according to claim 1, wherein the voltage applied to the wire is in the range of 10–40 V rms.

7. A process according to claim 6, wherein the voltage applied to the wire is approximately 25 V rms.

8. A process according to claim 1, wherein the wire is in the range of 1–4 cm long and has a diameter in the range of 0.005–0.050 inches.

9. A process according to claim 1, wherein the wire is tungsten and the electrolyte solution is a one molar solution of KOH.

10. A process according to claim 9, wherein the wire is approximately 2 cm long and 0.010 inches in diameter and is dipped into the electrolyte solution a depth of 2 mm, and further including a graphite ring which operates as a counter electrode, the applied voltage is approximately 25 V rms, the time between steps is 500 ms and the preselected current is 0.20 amps.

11. A process according to claim 1, wherein the wire is Pt—Ir and the electrolyte solution is a 20% solution of KCN in $H_2O$.

12. A process according to claim 1, wherein each step is approximately 1.28 μm in vertical translation.

13. A process according to claim 1, wherein the wire is inserted into the electrolyte solution a depth of 1–3 mm.

14. A tip prepared by an electrochemical etching process comprising:

providing a wire to be sharpened to a tip;

placing the wire in a container containing an electrolyte solution and an electrode;

moving the wire into the electrolyte;

applying a voltage to the wire, etching the wire and monitoring the resulting etching current in the electrolyte;

stopping the etching process when a preselected current is reached; and including withdrawing the wire from the electrolyte step by step during the etching and at a time interval in the range of 1–700 msec and thereby producing a tip.

15. A process according to claim 14, wherein the preselected current is determined experimentally.

16. A process according to claim 14, including:

recording the etching current vs. etching time data, storing the data, and comparing it to similar previously stored data for the electrochemical etching process for preparing tips having a radius of curvature in the range of 50–150 nm, wherein when the recorded data closely corresponds to the previously stored data, the thus prepared tip has a radius of curvature in the range of 50–150 nm.

17. A process according to claim 14, wherein monitoring includes providing for taking etching current samples in a range of 8 samples with a 2 msec sampling period and 400 samples with a 165 μsec sampling period.

18. A process according to claim 17, wherein 200 samples with a 330 μsec are provided for.

19. A process according to claim 14, wherein the voltage applied to the wire is in the range of 10–40 V rms.

20. A process according to claim 19, wherein the voltage applied to the wire is approximately 25 V rms.

21. A process according to claim 14, wherein the wire is in the range of 1–4 cm long and has a diameter in the range of 0.005–0.050 inches.

22. A process according to claim 14, wherein the wire is tungsten and the electrolyte solution is a one molar solution of KOH.

23. A process according to claim 22, wherein the wire is approximately 2 cm long and 0.010 inches in diameter and is dipped into the electrolyte solution a depth of 2 mm, and further wherein the counter electrode is a graphite ring, the applied voltage is approximately 25

Vrms, the time between steps is 500 ms and the preselected current is 0.20 amps.

24. A process according to claim 14, wherein the wire is Pt—Ir and the electrolyte solution is a 20% solution of KCN in $H_2O$.

25. A process according to claim 14, wherein each step is approximately 1.28 μm in vertical translation.

26. A process according to claim 14, wherein the wire is inserted into the electrolyte solution a depth of 1–3 mm.

27. An electrochemical wire sharpening apparatus comprising:

a wire holder for holding a wire to be sharpened;

a container for containing an electrolyte solution and an electrode;

means for applying a voltage to the wire causing an etching current to flow between the wire and the electrode;

a micrometer; and a stepper motor;

wherein the stepper motor acts on the micrometer which in turn acts on the holder to move the wire step by step out of the electrolyte while the voltage is applied to the wire; and further comprising:

means for monitoring the etching current between the electrode and the wire; and means for cutting off the current to the wire when the monitored current reaches a preset cutoff point.

28. An apparatus according to claim 27 including:

means for recording etching current vs etching time data:

means for storing the data;

means for comparing the data to similar previously stored data for sharpening tips to a radius of 50–150 nm.

29. An apparatus according to claim 28, wherein the means for recording, the means for storing and the means for comparing is a computer.

* * * * *

UNITED STATES PATENT AND TRADEMARK OFFICE

CERTIFICATE OF CORRECTION

PATENT NO. : 5,286,355

DATED : February 15, 1994

INVENTOR(S) : Raul Fainchtein and Paul R. Zarriello

It is certified that error appears in the above—identified patent and that said Letters Patent is hereby corrected as shown below:

Column 6, lines 67-68, delete "wherein the counter electrode is a graphite ring" and substitute therefor -- including a graphite ring which operates as a counter electrode --.

Signed and Sealed this

Fourteenth Day of June, 1994

Bruce Lehman

*Attest:*

BRUCE LEHMAN

*Attesting Officer*

*Commissioner of Patents and Trademarks*